United States Patent [19]

Sallnert et al.

[11] 4,446,710

[45] May 8, 1984

[54] DEVICE FOR USE IN THE MANUFACTURE OF METAL CAN TOPS WITH PULL-UP RINGS

[75] Inventors: Kjell Sallnert, Malmö; Carl-Erik Fridh, Trelleborg; Manfred Hansson, Malmö, all of Sweden

[73] Assignee: Platmanufaktur AB, Malmo, Sweden

[21] Appl. No.: 16,877

[22] Filed: Mar. 2, 1979

[30] Foreign Application Priority Data

Nov. 27, 1978 [SE] Sweden ..... 7812169

[51] Int. Cl.[3] ..... B21D 39/03; B21D 51/00; B23P 11/00

[52] U.S. Cl. ..... 72/10; 29/407; 72/31; 413/66

[58] Field of Search ..... 29/407, 509; 72/10, 72/11, 31; 83/61, 63, 66, 67; 113/1 F, 121 A, 121 C

[56] References Cited

U.S. PATENT DOCUMENTS 3,179,764 4/1965 Wintriss ..... 83/61 X
4,140,072 2/1979 Bartling et al. ..... 113/1 F

FOREIGN PATENT DOCUMENTS 1005517 9/1965 United Kingdom ..... 83/61

*Primary Examiner*—Ervin M. Combs
*Attorney, Agent, or Firm*—Hane, Roberts, Spiecens & Cohen

[57] ABSTRACT

A metal can top rests on a tool seat for the purpose of riveting a pull-up ring to the metal can top. Riveting takes place with the aid of a dolly which moves back and forth relative to the tool seat. Transmitters are arranged in the tool seat to check that no foreign objects are present in it. Transmitters sense the movement of the dolly past a reference level as it moves towards the tool seat. In the riveting position the dolly presses the metal can top and associated pull-up ring against the tool seat, whereby the pull-up ring actuates a sensing pin and moves it to an indicating position which is sensed by a transmitter. The signals from the respective transmitters are received by a delay and control device. In the event of the presence of foreign objects in the tool seat, as well as in the event of an excessively long interval between the time the dolly passes the reference level and the time the sensing pin reaches the indicating position, the delay and control device actuates the drive device of the dolly, causing it to stop the movement of the dolly.

5 Claims, 1 Drawing Figure

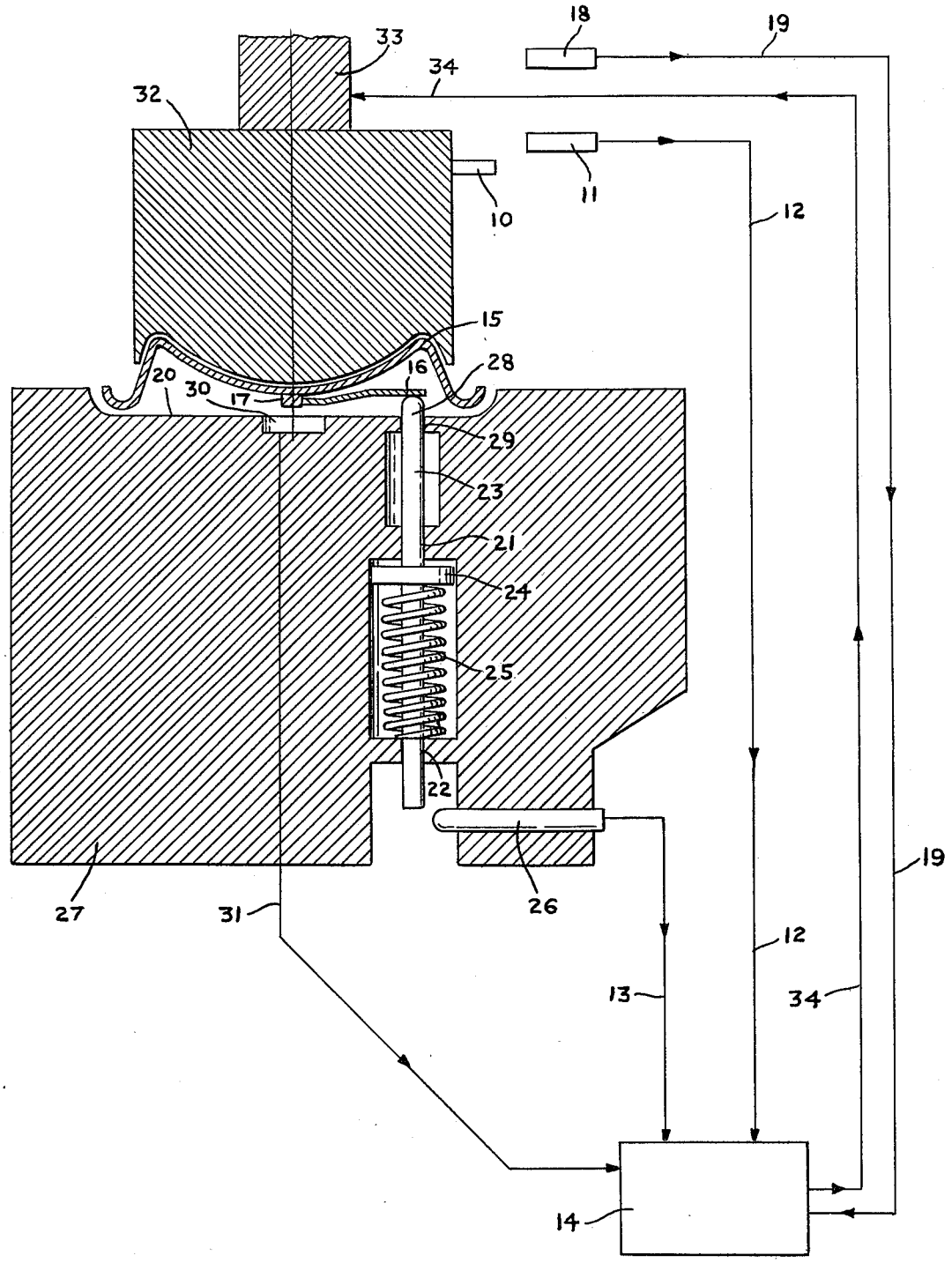
18
19
33
34
32
11
10
12
15
16
28
20
30
17
29
23
21
24
25
22
27
31
26
19
12
13
34
14

DEVICE FOR USE IN THE MANUFACTURE OF METAL CAN TOPS WITH PULL-UP RINGS

FIELD OF THE INVENTION

This invention relates to a method and apparatus for use in connection with the manufacture of metal can tops with pull-up rings. The invention is particularly concerned with that phase of manufacture in which a check is made to ascertain whether or not the pull-up ring is affixed to the metal can top.

BACKGROUND

The above-mentioned check is carried out in extremely short intervals of time, generally in conjunction with riveting the pull-up ring to the metal can top. Problems arise with presently known and used equipment because such equipment is not fully reliable. As a result, defective metal can tops are produced. The equipment used at present has mechanical linkages with actuator switches to stop production when a fault is detected.

The mechanical equipment has a limited service life and requires frequent checking and adjustment during production. Similar adjustment is naturally also required following the replacement of worn components in the checking equipment. On each such occasion the production tool must be stopped, replacement and/or adjustment effected and production restarted. Not until full production speed has all but been attained is it possible to see whether the measures taken have resulted in correct adjustment and proper operation of the checking equipment.

When the production tool retards or accelerates from or to full production speed, metal can tops are produced which must be scrapped. This is because the rivet is not correctly secured at low machine speeds.

Checking equipment so far used consequently entails numerous stoppages in production and each stoppage naturally reduces production volume. In addition to this, a number of defective metal can tops, which must be scrapped, are produced in connection with each stoppage.

Another disadvantage of the checking equipment presently used is that a loose pull-up ring or a piece of metal that has dropped into the seat of the production tool is often detected as a pull-up ring secured to the metal can top. A loose part of this kind in reality often causes damage to the metal can top or poor riveting of the pull-up ring. A large quantity of defective metal can tops may be produced if the situation is not observed through manual supervision.

SUMMARY OF THE INVENTION

The present invention seeks to eliminate the above-mentioned problems. Experiments have shown that the increase in production volume conferred by the invention is of appreciable financial importance.

In a device operating in accordance with the invention a metal can top with riveted pull-up ring is positioned in the seat of a tool. A dolly is moved down by a drive device against the metal can top and locates it in the seat. On passing a reference level a transmitter sends a signal to a delay and control device. During the final phase of the movement of the dolly locating the metal can top in the tool seat, the metal can top with pull-up ring is moved in the same direction as the dolly. A sensing pin accompanies the pull-up ring in its downward movement because the pull-up ring rests against the top of the sensing pin. Movement of the sensing pin is recorded by a sensing device, called a pin sensor hereafter, which by means of a signal to the previously-mentioned delay and control device indicates movement of the sensing pin. The delay and control device is arranged to record the combination of the two signals. If the second signal occurs within a previously determined space of time, counted from the time the first signal was sent, the delay and control device interprets this as signifying that the metal can top being checked is equipped with a pull-up ring. On the other hand, if the second signal occurs too late or is not sent at all, the delay and control device interprets this as signifying that the metal can top has no pull-up ring or that it is incorrectly affixed. The delay and control device then stops the drive device for moving the dolly.

In order to ensure maximum reliability in sensing the pull-up ring, the sensing pin is arranged eccentrically in relation to the center of the metal can top. In one embodiment, that part of the pull-up ring situated closest to the edge of the metal can top is allowed to actuate the sensing pin.

The above-mentioned reference point for recording the passage of the dolly is selected so that its position need not be changed in connection with production retooling. The distance travelled by the dolly and the dimensions of the metal can top, as well as the speed at which the dolly travels, determine the interval of time elapsing between indication that the reference point has been passed and location of the metal can top in the seat of the tool. In accordance with the invention, all that is needed to compensate for changes in the factors governing the interval of time is merely to adjust the length of the permissible time interval on the delay and control device. This adjustment can easily be carried out with the aid of electronic circuitry such as by the use of a flip-flop. Preferably the adjustment is manually effected.

The delay and control device is also connected to a position sensor that indicates when the dolly is in its upper position. Each time the dolly occupies its upper position, the delay and control device checks whether any signal is emitted from one or more transmitters in the seat of the tool. These latter transmitters emit a signal if a loose piece of metal is present in the seat. If a signal indicates the presence of such a piece of metal, the delay and control device stops the drive device for moving the dolly.

The previously-mentioned indication that the reference points have been passed during the movement of the dolly towards the seat of the tool is also, in one embodiment of the invention, combined with an indication that the dolly is in its upper position. The consecutive sequence of signals is as follows:

1. signal from position sensor for upper position of dolly,
2. signal from the pin sensor, and
3. signal from the reference level transmitter; the signal from the pin sensor must be received within previously determined intervals of time in order for the metal can top to be approved and passed.

BRIEF DESCRIPTION OF THE DRAWING

The invention is described in greater detail with reference to the sole FIGURE of the drawing showing a cross-section through a device operating in accordance with the invention.

DETAILED DESCRIPTION

Depicted in the FIGURE is a tool 27 with a seat 20. The seat is adapted to the shape of a metal can top 15 on which a pull-up ring 16 is affixed by means of a rivet 17.

The tool 27 cooperates with a dolly 32 which is moved by a drive device 33 from a starting position to a position at which the tool rests against the metal can top 15 and then back to the starting position. A stop 10 is attached to the dolly. The stop 10 interacts with a position sensor 18 and also with a transmitter 11 in such a way that the position sensor 18 and the transmitter 11 send signals to a delay and control device 14 via individual signal circuits 19 and 12 respectively when the tool stop 10 actuates position sensor 18 and the transmitter 11 respectively.

In tool 27 is arranged a vertically-oriented sensing pin 23, the top 28 of which is situated above the level of tool seat 20 when at rest. The sensing pin is arranged so as to move in relation to tool seat 20 in such a way that the upper surface of the top 28 of the sensing pin can be moved in relation to the tool seat 20. Orientation of the sensing pin is determined by a number of bearings 21, 22, 29.

A spring 25 engages with a stop flange 24 on the sensing pin in such a manner that the spring urges the sensing pin towards the tool seat. This movement is stopped when the stop flange 24 abuts against the center bearing 21.

A pin sensor 26 is arranged at the lower end of the sensing pin. The pin sensor sends a signal via a signal circuit 23 to the delay and control device 14.

In the tool seat 20 are arranged one or more transmitters 30 which via a signal circuit 31 send signals to the delay and control device when a metal object such as a loose piece of metal, a pull-up ring, etc., is present in the seat 20.

The device operates as follows: when the dolly 32 is in its upper position, stop 10 actuates position sensor 18. The position sensor then sends a signal to the delay and control device 14.

The delay and control device simultaneously checks whether a signal arrives via signal circuit 31 to indicate that a metal object is present in the seat 20. If this is the case, the delay and control device stops the drive device 33 at the same time as the fault is indicated by an alarm, for example. Movement of the dolly cannot be restarted until the metal object has been removed.

On the other hand, if transmitter 30 indicates that no object is present in the seat 20, the drive device 33 moves the dolly from its upper position down towards the tool seat 20. Stop 10 thereby passes transmitter 11 which sends a signal to the delay and control device. Since this has received the two signals in the right order, the delay and control device knows that the dolly is on its way to the tool seat 20. After a certain period of time the dolly reaches its lower position, thereby abutting against the metal can top 15 and locating the metal can top against the tool seat 20, whereby pull-up ring 16 rests against the top 28 of the sensing pin 23. During the final phase of the downward movement of the dolly, the sensing pin is moved slightly downward and the spring 25 is simultaneously slightly compressed. The sensing pin thereby assumes the position shown in the drawing. Pin sensor 26 senses the movement of the sensing pin 23 and sends a signal to this effect to the delay and control device 14. The dolly then returns to its starting position and spring 25 simultaneously returns the sensing pin to its upper position. The entire cycle is then repeated.

In the event that the pull-up ring 16 is missing on the metal can top 15, the sensing pin 23 does not move as previously described. As a result, no signal indicating the presence of a pull-up ring is sent from pin sensor 25 to the delay and control device 14. When the preset interval of time has elapsed, the delay and control device 14 sends a signal via signal circuit 31 to the drive device 33 and movement of the dolly is interrupted.

An important characteristic of the described device is the possibility of regulating the permissible interval of time between the signals from the position sensor and the pin sensor. The advantage gained by this is that adjustment or replacement of tools merely requires adjusting the length of the aforementioned interval of time.

The position of the sensing pin 23 is also an important feature of the device. In previous designs the sensing pin has been situated centrally in the tool. Through the position now selected, sensing of the pull-up ring takes place in an area where the ring is at a greater distance from the metal can top. Sensing reliability and safety is hereby increased.

What is claimed is:

1. Apparatus for preventing the manufacture of defective products in connection with the production of metal can tops with a pull-up ring, said apparatus comprising a dolly for riveting a pull-up ring to a metal can top, drive means for driving said dolly from a starting position to a working position and back to the starting position, a tool seat located so that in said working position said dolly cooperates with said tool seat to rivet the pull-up ring to the metal can top with the pull-up ring facing said tool seat, transmitter means for sensing the passage of said dolly past a reference level and for sending a corresponding signal when said dolly is moving towards said seat, a sensing pin protruding from the surface of the seat to be moved towards the surface of the seat by said pull-up ring of the metal can top when said dolly is in said working position and the pull-up ring is being riveted to said metal can top, sensor means for sensing movement of said sensing pin and for the generation of a corresponding signal, and delay and control means for receiving said signals from said transmitter means and said sensor means for sending a signal to said drive means for stopping the movement of the dolly when a predetermined period of time between said signals is exceeded.

2. Apparatus as claimed in claim 1 wherein said delay and control means is manually adjustable to provide a maximum period of time for said predetermined period.

3. Apparatus as claimed in claim 1 comprising a position sensor coupled to said delay and control means and sensing that the dolly is in its starting position, the direction of travel of said dolly when passing the reference level being determined by said delay and control means which received a signal from said position sensor and subsequently a signal from said transmitter means confirming movement towards the seat when the interval between the two signals lies within said predetermined time.

4. Apparatus as claimed in claim 3 comprising second transmitter means in the tool seat for generating a signal to indicate that a metal object is resting against the seat, said second transmitter means being connected to said delay and control means to act in combination with the signal from said position sensor to operate said delay and control means for the supply of a signal to said drive means for stopping the movement of the dolly.

5. Apparatus as claimed in claim 1 wherein said sensing pin is eccentrically located in said seat so that the top of said pin contacts that part of the pull-up ring situated closest to the edge of the metal can top.

* * * * *